United States Patent [19]

Franklin

[11] 4,001,908

[45] Jan. 11, 1977

[54] SWEEPING APPARATUS FOR COUPLING TO A MOTORIZED VEHICLE

[76] Inventor: David W. Franklin, 3416 Stanford St., Dallas, Tex. 75225

[22] Filed: Mar. 3, 1975

[21] Appl. No.: 554,967

[52] U.S. Cl. ..... 15/83; 56/218; 280/405 A

[51] Int. Cl.[2] ..... E01H 1/04

[58] Field of Search ..... 15/79, 82–87, 15/340; 74/206, 214–216; 56/DIG. 4, 16.4, 218

[56] References Cited

UNITED STATES PATENTS

| | | | |
|---|---|---|---|
| 1,268,698 | 6/1918 | Drummond | 56/218 |
| 2,546,531 | 3/1951 | Vutz | 56/218 X |
| 2,709,269 | 5/1955 | Williams | 15/83 X |
| 2,717,654 | 9/1955 | Andersen | 74/216 X |
| 3,354,489 | 11/1967 | Ehrlich | 15/83 |
| 3,493,987 | 2/1970 | Longnecker | 15/83 |
| 3,568,232 | 3/1971 | Swanson | 15/83 |
| 3,713,284 | 1/1973 | Dankel et al. | 15/83 X |

FOREIGN PATENTS OR APPLICATIONS

| | | | |
|---|---|---|---|
| 992,015 | 5/1965 | United Kingdom | 15/83 |

*Primary Examiner*—Edward L. Roberts
*Attorney, Agent, or Firm*—Crisman & Moore

[57] ABSTRACT

A sweeping apparatus is provided with means for coupling to a motorized vehicle for towing therebehind and brushing dirt, debris, and the like off a surface over which the vehicle may pass. The sweeper comprises a housing having a transversely extending sweeping brush rotatably mounted in a generally horizontal surface engaging configuration adjacent a bin structure for collection of the sweepings. The brush is directly driven by the surface engaging wheels through a frictional engagement between one or both of the wheels and expandable drive capstans coaxially affixed to the brush. A tow frame is pivotally mounted to the housing at the forward end, which frame is adapted for releasable coupling to the towing vehicle. Means are provided for controlling the pivotal angularity between the tow frame and the housing which provides selectivity in adjusting the degree of interengagement or nonengagement between the brush and the swept surface. Lifting fork receiving channels are positioned in parallel spaced relationship on opposite sides of the housing providing a means for lifting and inverting the housing to eliminate the dirt and debris collected in the bin area.

7 Claims, 2 Drawing Figures

SWEEPING APPARATUS FOR COUPLING TO A MOTORIZED VEHICLE

BACKGROUND OF THE INVENTION

1. Field of Invention

The present invention relates to street sweepers and, more particularly, to non-motorized, towable sweeping apparatus for collecting dirt and debris upon its conveyance over a surface to be swept.

2. Technical Considerations

Advancements in the art of street sweeping apparatus are characterized and embodied in patents spanning more than a century. The original mechanized models were the non-motorized versions, necessitated by the early state of the art. Incumbent upon the inventors of the 1800's was a street sweeping machine utilizing "horse power" in its strictest sense. Such machines utilized the rotation of the ground surface engaging wheels to drive the sweeping brushes in the sweeping operation. Such a sweeper is disclosed in U.S. Pat. No. 35,365, issued to Daboll in 1862, wherein a cylindrically shaped brush was operated through the engagement of rigid frictional drive rollers for the collection of dirt and debris in bin storage areas formed within the sweeping unit housing.

Advancements in the sweeping art were consistent with those of a mechanized society. Chain drives, gears, and pall and ratchet combinations were introduced in an effort to achieve a sweeping unit design which could be built, maintained, and operated economically with great effectiveness. With the advent of the internal combustion engine, such units became "self-powered" and therefore relatively complex and costly. But as complexity increased, so did problems in operation and maintenance. Debris and unwanted materials, although the object of the sweeping operations, formed abrasives often interfering with the myriad of moving parts in the self-powered sweeping unit.

The self-powered units proved to be most effective in large scale sweeping operations. However, due to the overall size of such units, they were impractical for smaller industrial uses where the several cleaning locations were spread apart. Physically and economically it proved to be impractical to transport large, self-powered sweepers for relatively small cleaning jobs.

As more recent patents illustrate, sweeper attachments have therefore been provided for lift trucks and similar motorized vehicles particularly adapted for the pushing or pulling of the attachment over the surface to be swept. Such vehicles are often located at industrial sites for other, unrelated uses.

Some of the advancements in attachable sweepers utilized the developments of the early art in direct wheel to brush drive rotational interengagement. For example, the U.S. Pat. No. 3,354,489 issued to S. V. Ehrlich on Nov. 28, 1967, discloses a sweeper attachment for a lift truck. This and other similar sweeping machines incorporate drive wheel transmissions, one way over-riding clutches, enclosed bin areas adjacent the brush and means for engaging the unit for lifting it to deposit the debris within. These units further include features such as floating steering, and a method of attachment utilizing the adaptation of all makes and models of lift trucks.

It has been recognized that the use of lifting forks, as used on fork lifts, greatly facilitates the elimination of debris and waste in attachable sweeping units, by the elevation of same above a refuse container for discarding such dirt and debris. However, the impracticality of using such a fork lift device for the complete sweeping operation has likewise been recognized. The general concept of using a sweeping apparatus with a trash bin, which can be towed behind any variety of motorized vehicles such as pick-up trucks thus becomes an optimal design goal.

The fullest utilization of the state of the art has not been recognized in the development and reduction to practice of modern sweeping concepts. The frictional engagement-type transmissions have consistently used rigid drums for drive capstans, having outer peripheries with serrated surfaces to improve friction thereon. The expense of such designs is complicated by the problem of wear, adjustment in the magnitude of frictional engagement, and susceptibility to abrasives encountered in the sweeping operation. Complicated and expensive adjustment mechanisms, linkages, and contamination precautions are often provided or else separate drive systems such as hydraulic or chain drive take offs are incorporated. Such systems are designed around these problems rather than attempting to deal with them.

Frictional drive transmissions require merely two engaging drive surfaces having a suitably high coefficient of friction. The engaging drive elements, by necessity, must be compatible, whether wet or dry, of economical construction, suitably maintenance free, relatively impervious to dirt, debris and other abrasives encountered in the sweeping operation and provide a means for adjustment of normal force and size of the contiguous peripheral portions.

Heretofore sweeping apparatus has been unavailable for the brushing and cleaning operations above described with the simplicity of construction, economic features, and other advantages over the prior art. With the growing demand for maintenance and cleaning of segregated paved surfaces due to the widespread placing of same, the need has been fostered for the construction of such a sweeping unit. This need, as well as the requirements of conservation of energy and control of economy has necessitated the creation of an improved brushing and sweeping apparatus.

SUMMARY OF THE INVENTION

One object of the present invention is to provide a new and improved apparatus for sweeping surfaces such as pavement and the like free of dirt and debris.

Another object of the present invention is to provide a new and improved sweeping apparatus which may be attached to a motorized vehicle for towable conveyance across a surface to be swept.

Yet another object of the present invention is to provide a new and improved sweeping apparatus for attachment to a motorized vehicle in which the conveyance of the sweeping apparatus provides the rotatable drive for the sweeping brush facilitating the pick up of dirt and debris over the surface to be swept.

Still another object of the present invention is to provide a new and improved apparatus for sweeping a surface wherein the sweeping brush is rotatably driven by a surface engaging wheel through one or more expandable drive capstans coaxially affixed to the brush.

Another important object of the present invention is to provide a new and improved sweeping apparatus in which the engagement of the sweeping brush and the surface to be swept is controlled through the angularity between the tow frame and the sweeping housing.

A further object of the present invention is to provide a new and improved sweeping apparatus for releasably coupling to a motorized vehicle and of such construction so as to be capable of being lifted to an inverted position for elimination of the sweepings therein.

A new and improved apparatus for coupling to a towing vehicle for sweeping and removing dust and debris and the like from a surface over which a vehicle may pass, in accordance with the principles of the present invention, may include a housing having a bin area formed therein adjacent to a transversely extending sweeping brush rotatably mounted in parallel axial alignment with a pair of surface engaging rubber tired wheels. One or more pneumatic, expandable capstans are mounted on a first end of the sweeping brush fixed in coaxial relationship thereto and adapted for frictional engagement with an adjacent rubber tired surface engaging wheel for imparting rotational motion to the brush. Cooperative means are thus provided for frictionally engaging the first wheel and the capstan whereby the brush is selectively rotatably driven.

The housing is provided with means for emptying the debris from the bin area comprising a pair of parallel fork receiving channels extending along opposite sides thereof whereby the housing may be lifted and supported in an inverted position. A hinged panel section formed along the top of the housing provides an access port for elimination of the debris within.

A tow frame is pivotally connected to the housing at one end. At the other end of the frame means are provided for releasably coupling to a towing vehicle. Means for controlling the angularity between the tow frame and the housing is provided, whereby, with the surface engaging wheels supporting the housing and the end of the tow frame coupled to a vehicle, such pivotal movement of the tow frame relative to the housing imparts a resultant pivotal movement of the housing about the supporting wheels and a resultant adjustment in the degree of interengagement and nonengagement between the sweeping brush and the surface to be swept.

The sweeper is supported on the surface to be swept by the two surface engaging wheels freely rotatable except for the drive capstan engagement. The towing operation is thus accomplished through the directional guiding of the tow frame serving as a yoke providing a turning radius and function equivalent to that of similar lightweight towable vehicles such as boat trailers.

The drive capstan is an expandable, driven element with an axis of rotation parallel to that of the surface engaging wheel. The capstan is formed of a pneumatic, rubber tired wheel mounted upon a hub coaxially coupled to the brush. Variations in the air pressure in either the surface engaging wheel or the capstan alter the engagement of the contiguous peripheral surface areas between the two elements and the normal force transmitted therebetween. Normal force is necessary for the proper frictional engagement providing the drive transmission means for the sweeping operation. The use of such a rubber tired, expandable capstan in the form of a vehicle tire provides for an economical and substantially maintenance free operation. The adjustability feature, coextensive with the use of such an expandable capstan, is a marked improvement over the prior art serrated or otherwise machined surface necessary for providing the requisite frictional engagement. The expansion characteristics of the two engaging elements provide a self-compensating transmission system most appropriate in this application.

The utilization of a tow frame pivotally attached to the housing at one end and releasably coupled to the towing vehicle at the other provides a brushing depth selectivity adjustment without the provision of complex mechanical elements within the housing itself. The means for controlling the angularity comprises an expansion and tension means for interacting to provide the necessary angular adjustment and requisite pivotal movement of the tow frame relative to the housing. The tensioning means is provided through a pair of tension springs positioned in parallel alignment for sequentially engaging to provide a pivotal movement upon the tow frame. A threaded shaft extends through a threaded journal securely affixed above and attached to the tow frame. One end of the threaded shaft abutts a pivotal extension of the housing for providing the expansion force for imparting the requisite pivotal movement. Rotation of the threaded shaft is provided through a handle extending from the forward end thereof adapted for manual operation.

The adjustment mechanism is provided above the sweeping operation area of the unit and free of the contaminants associated therewith. This location facilitates manual operation in the adjustment of brushing depth. The axis of the surface engaging wheel serves as a reference point for all pivotal movement of the housing, and the vehicle end of the tow frame serves as a second reference point, with all pivotal movement therebetween resulting in an arcuate movement of the sweeping brush about the wheel axis, to and from the pavement therebelow.

The elimination of sweepings within the housing is provided through two bin access doors. A first door positioned atop the housing is adapted to swing outwardly under its own weight when the unit is inverted. A second door forming an aft wall of the housing is adapted to swing open under a manual opening operation to form an elimination port for the debris contained therein.

The fork receiving channels provide a coupling means for engaging the lifting forks of a front end commercial fork loading vehicle. The channels are so constructed with the housing so as to support same in the loaded condition inverted or upright. Suitable friction-pads may be positioned within the channels for non-slip operation during the lifting procedure.

The operation of the vehicle is thus simplified by providing an economical unit which can be placed at a shopping center or other location having pavement to be swept and left there over night in lieu of transportation to another site and the necessary emptying process therebetween. Such a unit can be constructed inexpensively enough so that a plurality of such units may be provided in a selected size. The only motorized vehicle necessary for operation is that of a conventional pick-up truck, or the like, having a suitable hitch coupling thereon. The simplicity of this construction provides a light enough housing to facilitate the lifting by commercial waste fork-lift trucks.

BRIEF DESCRIPTION OF THE DRAWINGS

A complete understanding of the present invention will be obtained from the following detailed description thereof when read in conjunction with the accompanying drawings, wherein.

DETAILED DESCRIPTION

Figure 1:
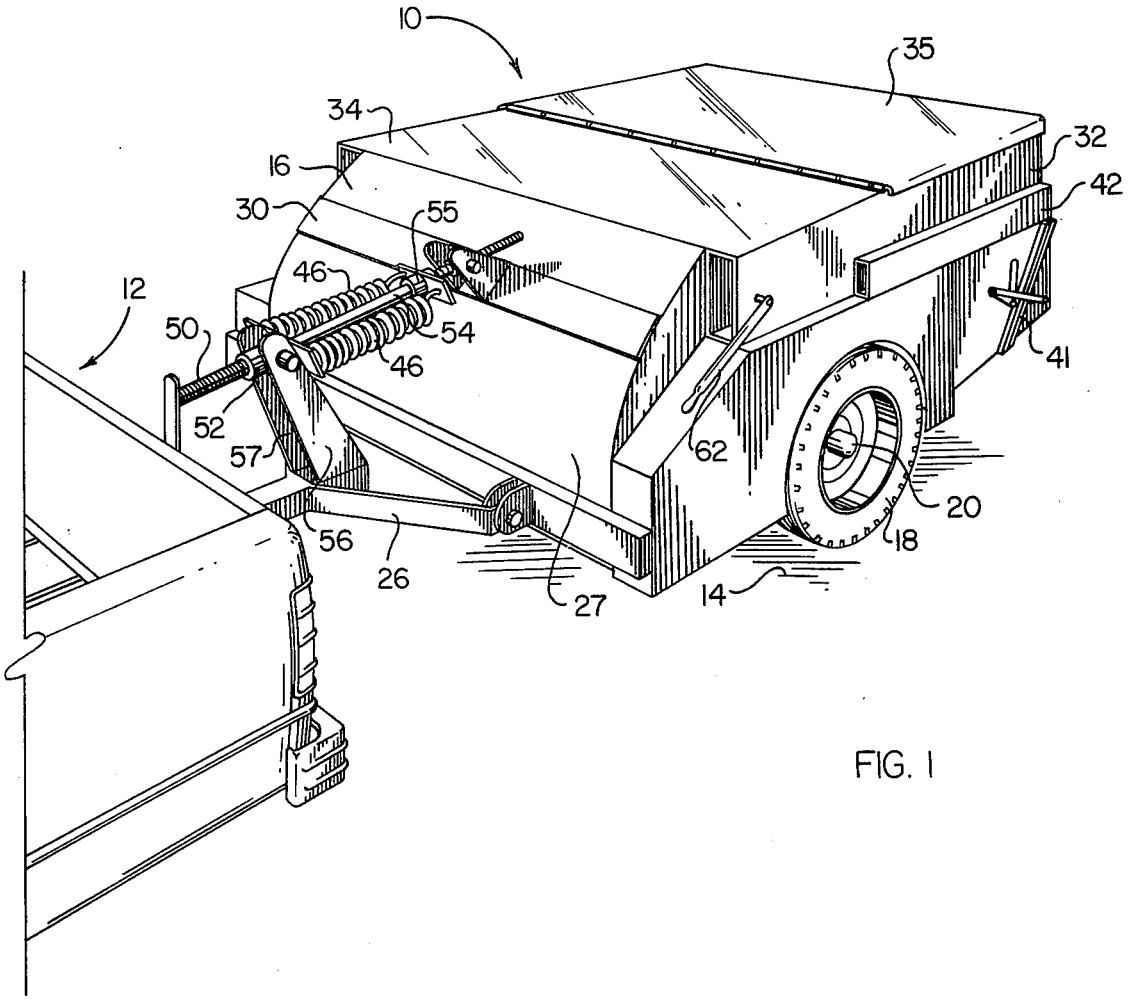
FIG. 1 is a perspective view of one embodiment of a sweeping apparatus for coupling to a motorized vehicle in accordance with the principles of the present invention.

Attention is first directed to FIG. 1 wherein a brushing apparatus or sweeper 10 is shown coupled to a motorized vehicle in the form of a pick-up truck 12. Sweeper 10 is designed to be towed behind the truck 12 over a surface 14 such as streets or the like for sweeping such areas clean of dirt, debris, and the like. Debris and unwanted substances, although the object of the sweeping operation, form abrasives often interfering with moving parts in the sweeping unit. In the present embodiment of sweeper 10, the number of these moving parts has been reduced as well as the complexity of their interaction. The sweeper 10 thus functions more effectively as a cleaning unit and provides a lighter, more compact easier to handle unit.

Sweeper 10 may be seen to include a housing 16, pivotally supported about and by a pair of surface engaging wheels 18-18 rotatably mounted on opposite sides of and in said housing by a shaft or axle 20, mounted in the generally lower central portion of said housing along a transversely extending horizontal axis. A cylindrically shaped sweeping brush 22 is rotatably mounted in the fore part of the housing 16 in a horizontal transversely extending relationship adjacent to and in parallel spaced relationship with the axle 20. A drive capstan 23 is mounted upon one or both ends of the brush 22, fixed in coaxial relationship thereto and adjustably positioned for selective engagement with the adjacent wheel 18. Such engagement provides for the rotation of said brush in a direction opposite to that of travel of the sweeper 10. A bin area 24 is formed in the housing 16 in cooperative relationship with the brush 22 to receive sweepings of dirt and the like therefrom during operation. A tow frame 26 is pivotally mounted to a front wall 27 of the housing 16 and releasably coupled to the vehicle 12 through a coupling 28, in the form of a trailer hitch, or the like. Expansion linkage 29 is constructed above the anterior end 27 of the tow frame 26 linking said tow frame and the housing 16 for adjusting the pivotal movement and the angularity therebetween.

The housing 16 is formed of lightweight metal walls and constructed around a suitably strong frame 30. The walls include a curved front wall 27, opposite side walls 32—32, a top wall 34, a partially open, slanted bottom wall 36, and an end wall 38. Said walls are constructed for protecting the moving parts within and to form the enclosed bin area 24 in the necessary refuse receiving configuration.

The towing of the sweeper 10 produces rotation of the wheels 18—18 and provides rotational power for the brush 22. As viewed in FIG. 1, the brush 22 is rotatably driven in a clockwise direction through the frictional engagement between the capstan 23 and surface engaging wheel 18. Dirt and debris is swept generally forwardly and upwardly into the bin area 24. Wall 27 of the housing 16 is curved at a radius greater than that of the brush to serve as a guiding surface for the material swept by said brush to direct it upwardly and rearwardly into the bin 24. The type of brushing action is of generally conventional form. The improvements as described herein are not so conventional and, specifically the brush engaging means, emptying means and transmission means provide a new and useful result.

The housing 16 is designed and constructed for the elimination of the dirt and other sweepings in the refuse bin 24 in two fashions. The top wall 34 is formed with a thin walled door section 35 hingedly mounted thereon for swinging open manually or under its own weight if the housing 16 is inverted. A second access door to the refuse bin 24 is formed along the lower, portion of wall 38 and includes a hinged section 40.

Section 40 forms the lower quadrant of the bin area 24 and forms a retaining wall for partial support of the dirt and other debris swept into the bin 24, and is opened and closed by closure linkage 41. When panel 40 is opened, an access port is formed where such debris is eliminated both under its own weight as well as by manual effort in the sweeping out of the remaining portions through this access port.

The inverting of immobile refuse containers for emptying is common practice for industrial waste disposal units. Such an emptying means is advantageous from a time and money standpoint. Therefore, a means for inverting the sweeper 10 is provided by a pair of fork receiving channels 42—42 formed in parallel spaced relationship along sidewalls 32—32 in a generally horizontal configuration. The channels 42—42 are adapted for receiving forwardly extending lifting forks or tines (not shown) of a conventional frontend loading truck, adapted for handling immobile refuse bins. Such trucks are in common use for both residential and industrial trash and waste pick up. The lifting forks on these trucks are usually provided in standard dimensional configurations adjustable thereto for interchangeability between refuse containers to be lifted.

Refuse collected in the sweeper 10 may thus be emptied with minimal manual effort. When the sweeper 10 is left overnight at a discarding site, a suitably adapted lifting truck may simply insert its forward lifting fork, invert the unit 10 and the debris will fall under its own weight through the hinged door section 35 swinging downwardly. The engaging surfaces of the channels 42 may also be provided with pads of rubber or similar material having a suitably high coefficient of friction so as to provide a semi-rigid non-slip surface for engagement with the fork-surface area. This design alleviates the need of locking mechanisms or other apparatus adding to the complexity and expense of the overall unit 10.

Figure 2:
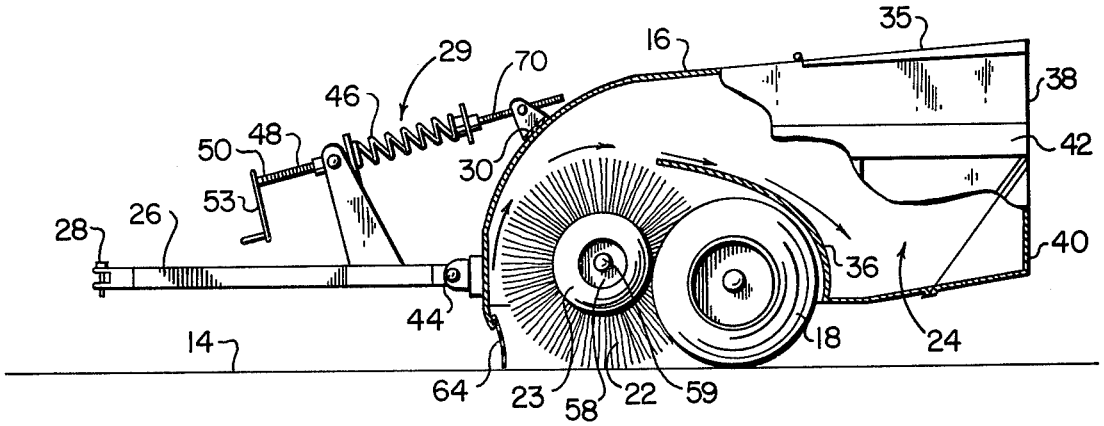
FIG. 2 is a sectional view of the sweeping apparatus of FIG. 1 taken along the lines 2—2 thereof.

As shown most clearly in FIG. 2, the expansion linkage 29 is positioned above the tow frame 26 connecting said tow frame and the upper portion of the housing 16. Adjustment in linkage 29 causes the tow frame 26 to pivot at the housing 16 through a pivotal connection 44 linking the posterior end of the tow frame 26 and an anterior section of the frame 30. The pivotal connection 44 is constructed in the form of a hinged joint allowing bilateral, arcuate movement of the tow frame 26 thereabout. Variations in the length of this linkage determines the distance between these two connecting points and the resulting angularity between the tow frame 26 and the housing 16.

The expansion linkage 29 comprises first and second spring members 46—46 and expansion member 48. Spring members 46—46 are elongated, helical tension springs connected between the housing 16 and the tow frame 26, and when expanded produce a bending moment about the pivot hinge 44 tending to cause the frame 26 to pivot toward the housing 16 in a clockwise motion as viewed in FIG. 2. The expansion member 48 is likewise connected between the housing 16 and the tow frame 26 and is adapted for selective expansion causing said tow frame to pivot about the pivot hinge 44, resulting in expansion of the springs 46—46. This expansion causes an angular arcuate movement of the tow frame 26 away from the housing 16 in a counterclockwise motion as viewed in FIG. 2. A suspension system is likewise created by the springs 46—46 for operation of the brush 22, as will be discussed in more detail below.

As shown most clearly in FIG. 1, the expansion member 48 includes a threaded shaft 50 extending through and engaging a threaded journal 52, with the posterior end of the shaft 50 extending through a partially hollow extension member 54, pivotally connected to and extending forwardly of said housing through a rigid mounting element 70 extending therefrom.

The extension member 54 includes a cylindrical housing in the form of a pipe having an open-ended, unconnected anterior end and a solid posterior section 55 pivotally attached to the frame 30, through mounting element 70 atop the housing 16. The pipe 54 is of sufficient diameter to freely receive the threaded portion of the shaft 50 down to a solid posterior section 55 wherein it abuts. Rotation of the shaft 50 wherein provides a movement through the journal 52 increasing or decreasing the tension in springs 46 and the distance between the journal and housing 16 through the abutment on the solid posterior section 55. The resultant angular motion of the tow frame 26 to the desired orientation provides the selective brush engagement as discussed in more detail below.

As shown in the present embodiment of FIGS. 1 and 2, the journal 52 is positioned above the tow frame 26 and connected thereto by structural frame members 56 and 57 formed of suitably strong material such as ½ inch iron plate securely affixed at one end to the tow frame 26 and at the other end to the journal 52 by welding, or the like. A pivotal movement is therefore applied to the tow frame 26 during adjustments of the linkage 29. Other forms of expansion members may be provided such as an hydraulic jack apparatus which can provide a uni-directional force and expansion necessary to expand the springs and impart the pivotal movement of the tow frame about the pivot 44.

The pivotal movement between the tow frame 26 and the housing 16 is a relative interaction. When the anterior end of the tow frame 26 is securely coupled to a vehicle 12 through the coupling 28, a fixed reference point is created. The weight of the housing 16 upon the wheels 18—18 creates a second reference point. Arcuate movement as described above, between the frame 26 and the housing 16, produces a resultant pivotal motion of the housing 16 about the axle 20. In this configuration both ends of the apparatus are maintained as reference points and all resultant motion is manifested between said points.

By positioning the brush member 22 forward of the wheels 18—18, as shown, the pivotal movement of the housing 16 therein produces an arcuate movement of said brush in a path to or from the surface 14, as determined by the selected adjustment of the linkage 29.

Although the relative position between points on the tow frame 26 and the housing 16 is the primary variant, the desired resultant relative position is that of brush 22 engagement or nonengagement with the pavement 14. This manner of brush depth control alleviates the necessary extra apparatus for varying brushing depth through variations of brush axis height with relation to the housing, as in most prior art configurations. By eliminating such apparatus and the associated complexity therein, a simplified means for controlled brushing depth and engagement is provided.

Expansion in linkage 29 produces counterclockwise relative movement of the tow frame 26 as seen in FIG. 2 and the retraction of the brush 22 from the surface 14 along the arcuate path around the axle 20 of the wheel 18. Such movement is the result of increasing the distance between the housing extension 54 and journal 52 through clockwise rotation of the shft 50 abutting said housing extension. The increased distance between said points produces a resulting expansion in the spring elements 46—46, which elements produce forces resisting this movement. The reverse movement, that of engaging the brush with the pavement to the desired depth, would be provided by reducing the distance between the housing 16 and journal 52 and allowing the spring elements 46—46 to contract. It may be seen that the spring elements 46—46 provide offsetting balance forces for pivotal movement about the axle 20 due to the loading of debris in the bin area 24 aft of the pivot axis. For this reason the spring elements 46—46 are staggered to compensate for this offsetting balance force. In this manner, one spring element commences expansion prior to that of the other.

The structural arrangement of the support frame members 56 and 57 as discussed above create a support truss to transfer the pivotal movement created through the linkage 29 and the weight of the housing 16. The necessary spring constants for the spring elements 46—46 are selected in cooperation with the necessary pivotal forces and moment arm design length. The magnitude of manual force required for adjustment of the linkage 29 is therefor a design consideration. For this selected movement the thread pitch of shaft 50 and engaging thread journal 52 may be varied to provide the necessary driving force within the range of manual operation. The length of the handle on the end of shaft 50 may also be varied for increased operator leverage to compensate for these requirements.

Friction drive means are often used in rotary brush drive applications and is a common design in the prior art. The wheel to capstan transmission provided herein is a distinct variation from existing designs. The peripheral surfaces of both elements are rubber tired having treads formed therein for improving frictional engagement. The surface engaging wheel 18 is by design a rubber tired pneumatic element having such treads formed therein for improved traction upon pavement. A compatible surface is therefor provided in capstan 23 by the adaptation of a smaller, vehicular type, rubber tired element also of the inflatable variety. The design considerations of friction coupled with the inflation and the inherent expansion characteristics of each transmission element provide for an optimal transmission system design.

The expansion characteristics of each element provide an additional means for adjusting the normal forces between the two drive elements. The inflation pressure of each element substantially determines its resilience characteristic. When the axial alignment of the elements is such that the contiguous peripheral surfaces so engage forming an enlarged plane portion therebetween, the magnitude of the frictional engagement is dependent upon the expansion.

The relative diameters of the two transmission elements produce a transmission drive ratio. In the present embodiment for every one revolution of the wheel 18, the drive capstan 23 and the brush 22 are turned approximately 2 times. The brush rotation speed is thus a function of the respective circumference of the wheel 18 and the capstan 23.

The expansion characteristic of the elements further provides a means for compensating and adjusting for wear of both the brush and the transmission elements. This adjustment means is provided through the needle valve in the capstan hub and adjustments made in the same manner as inflating and deflating wheel 18 and any other vehicle pneumatic tire.

Each capstan 23 has a central hub 58 affixed to an axle 59 of the brush 22. The secured concentric positioning provides an axis of rotation in parallel spaced relationship with the axle 20. The driving wheels 18—18 rotate in one direction imparting a rotation of the brush 22 in the opposite direction providing a uniform rotary motion sweeping debris forward, up, and into the bin area 24.

The friction drive is selectively engaged during operation and disengaged during transportation of the apparatus. Thus, a structure for selectively establishing frictional engagement between the surface wheel 18 and the capstan 23 is provided through a slide linkage apparatus between the axle 20 and the brush 22. Such cooperative means includes a generally horizontal set of tracks (not shown) on opposite sides of the brush 22 for the brush axle 59 to slidably move within, and linkage means for controlling the selective position of said axle therein. A lever 62 is shown in FIG. 1 for operating the brush linkage. The linkage provides not only a means for movement of the brush but for secured positioning at the desired engagement location. During transportation between sweeping operations, the transmission elements are disengaged so that brush rotation is eliminated. Transportation is also facilitated by disengaging the brush 22 from the pavement 14 through the angular linkage means 29 as described above.

The transmission system as provided in sweeper 10 provides sufficient rotational brushing action with the desired speed and power necessary for commercial sweeping operations. As described, capstan-wheel engagement is provided upon a single or both sides of the housing 16. An outside wall of the housing 16 covers and protects the inner action of these two elements. Maintenance, including inflation pressure adjustments, may be performed through a suitable access port formed in the housing adjacent the capstan 23 (not shown).

The operation of the sweeper 10 requires only a vehicle having a suitable mating coupling for sweeper coupling 28. The sweeper 10 may be quickly and easily coupled through a ball hitch or the like on the end of the vehicle, such as the truck 12. With the tow frame secured to the vehicle, the sweeper 10 is ready for transport to the location for the cleaning operation. There the drive capstan assembly is positioned in engagable relationship with the wheels 18—18. The brushing depth is selected by the adjustment of the pivot linkage 29. The sweeper 10 is then towed in a forward direction imparting rotation to the brush 22 to sweep dirt and debris against an adjustable rubber flap 64, in the housing 16, and into the bin area 24.

When the bin area 24 is filled to the desired level, it can be emptied in one of two fashions. The sweeper 10 may be positioned adjacent an area where the debris is to be stacked or piled and the rear panel section 40 opened to facilitate the manual emptying thereof. The more sophisticated dumping technique incorporates detaching the entire sweeping unit 10 from the towing vehicle for lifting by a lift truck as described above. When the sweeper 10 is suspended in an inverted position, the top panel section 35 is designed to swing open under its own weight and the weight of the debris within to be eliminated therefrom.

Generally the sweeping operation upon a single site is accomplished without requiring the emptying of the bin area 24. In this manner the low cost sweeping unit may be left at the sweeping site overnight for emptying the following day by commercial vehicles. The low cost and maintenance required in such a unit facilitates this form of operation. The housing 16 is so constructed to form a convenient refuse container when not in use, and the elimination of the motorized drive and transmission means found in other units provides an assembly which is economically feasible for multiple placement. The simplicity of fabrication and construction provide a lightweight inexpensive unit which may greatly increase the efficiency of sweeping operations by alleviating emptying and transporting the unit between numerous sweeping sites.

When transportation of the apparatus is required, the simplicity of disengagement of the transmission means and the disengagement of brush 22 and the pavement 14 through manual means provide a simple and inexpensive method of operation.

It is believed that the operation and construction of the above-described sweeping apparatus will be apparent from the foregoing description. While the particular embodiment shown and described has been characterized as being preferred, it will be obvious that various changes and modifications may be made therein without departing from the spirit and scope of the invention as defined in the following claims.

What is claimed is:

1. For coupling to a motorized vehicle, a brushing apparatus of the type having a housing supporting a transversely extending brush rotatably mounted therein for sweeping and moving dirt, debris and the like from a surface over which the vehicle may pass, and which brush rotation is derived from an interconnection between a surface engaging wheel and a drive capstan coaxially affixed to said brush, comprising:

a tow frame forwardly extending from said housing and adapted for coupling to the motorized vehicle for towing;

hinge means on a rearward end of said frame hingedly attaching said frame to the housing; and expansion linkage means interconnecting a portion of said tow frame and a portion of the housing for determining the resulting angularity between said tow frame and the housing and the degree of engagement of the brush with the surface over which the vehicle may pass.

2. The apparatus as defined in claim 1 wherein said expansion linkage means includes:

resilient tension means connecting a portion of said tow frame and the upper portion of the housing for biasing said tow frame toward the housing; and expansion means for adjustably determining said resulting angularity between said tow frame and the housing.

3. The apparatus as defined in claim 2, wherein said resilient tension means includes:

first and second spring elements positioned in substantially parallel spaced relationship, one end of each spring element connected to a portion of said tow frame, and opposite ends of said spring elements connected to the upper portion of the housing, said first spring connected to commence expansion prior to that of said second spring so that said second spring will impart a tension force after said first spring has undergone extension.

4. The apparatus as defined in claim 2 wherein said expansion means includes:

a threaded shaft;

a handle affixed to a first end of said shaft;

a threaded journal rigidly secured to said tow frame and adapted for suitably receiving said shaft therethrough for rotation therein;

a hollow extension member pivotally attached to the housing at one end and, at the other end, adapted for freely receiving the threaded shaft therein; and a thrust member in the first end of said hollow member adapted for abutting the end of said threaded shaft and transmitting longitudinal force therethrough.

5. For coupling to a motorized vehicle for towing, a brushing apparatus of the type having a housing supporting a transversely extending brush rotatably mounted therein for sweeping and removing dirt, debris and the like from a surface over which the vehicle may pass and having a transmission means driven by a surface engaging wheel depending from the housing for driving the brush in a direction for sweeping dirt from the ground surface into the housing and a means for selectively determining the engagement of the brush with the sweeping surface and a bin formed in the housing for containment and receipt of the sweepings, and their elimination by a fork lift vehicle, comprising:

a hinged panel section along the top portion of the housing and adjacent the bin area, said panel section hingedly connected at a frontal edge portion to the top of said housing and extending rearwardly therefrom for swinging outwardly from the housing and creating a port for the elimination of the debris within the bin area; and first and second hollow channels positioned along opposite sides of the housing in parallel spaced relationship and adapted for receiving tines of a fork lift vehicle so that said apparatus may be lifted and inverted.

6. The apparatus as defined in claim 5 and further including an outwardly opening panel section adjacent said bin area hinged at a top edge portion thereof to the rearward end of said housing and extending horizontally therealong and pivotal about the hinged axis from a downwardly extending closed position to a generally vertical extending open debris eliminating position.

7. In a brushing apparatus for coupling to a towing vehicle for sweeping and removing dust, debris and the like from a surface over which the vehicle may pass, a housing;

a transversely extending sweeping brush rotatably mounted in said housing in generally horizontal surface engaging relationship;

an enclosed bin area formed in said housing adjacent to said brush for collecting debris and the like swept by said brush;

ports for eliminating the debris from said bin area;

first and second surface engaging pneumatic rubber tired wheels rotatably mounted in parallel spaced relationship in said housing for pivotal support thereof;

a rubber tired capstan mounted upon a first end of said brush and fixedly secured in coaxial relationship therewith;

cooperative means for selectively establishing frictional engagement between said first wheel and said capstan for selectively driving said brush rotatably upon rotation of said wheel;

a tow frame pivotally connected to said housing at one end and adapted for pivotally and releasably coupling to a towing vehicle at the other end; and means for controlling the angularity between said tow frame and said housing, and with said wheels supporting said housing and the end of said tow frame attached to a vehicle, for imparting pivotal movement to said housing about said wheels to adjust the degree of interengagement between said brush and the swept surface.

* * * * *